US008201858B1

(12) United States Patent
Moon et al.

(10) Patent No.: US 8,201,858 B1
(45) Date of Patent: Jun. 19, 2012

(54) LOCKING SYSTEM FOR MORTISE LOCK BASE

(75) Inventors: Charles Moon, Covina, CA (US); Michael Wright, Covina, CA (US)

(73) Assignee: Townsteel Inc., Covina, CA (US)

( * ) Notice: Subject to any disclaimer, the term of this patent is extended or adjusted under 35 U.S.C. 154(b) by 531 days.

(21) Appl. No.: 12/289,804

(22) Filed: Nov. 5, 2008

(51) Int. Cl.
*E05C 1/12* (2006.01)

(52) U.S. Cl. ..... 292/164; 70/144; 70/152; 70/153; 292/165; 292/34; 292/33; 292/37; 292/40

(58) Field of Classification Search ..... 70/102, 70/103; 292/1, 1.5, 165, 169.14, 169.22, 292/150, DIG. 60, 244
See application file for complete search history.

(56) References Cited

U.S. PATENT DOCUMENTS

| | | | | | |
|---|---|---|---|---|---|
| 602,886 | A | * | 4/1898 | Voight | 292/165 |
| 862,230 | A | * | 8/1907 | Young | 70/153 |
| 909,888 | A | | 1/1909 | Goldstone | |
| 1,820,565 | A | * | 8/1931 | Hines | 70/107 |
| 3,361,462 | A | * | 1/1968 | Foster | 292/165 |
| 3,672,714 | A | | 6/1972 | Schultz | |
| 3,750,433 | A | * | 8/1973 | Sanders | 70/486 |
| 3,808,849 | A | * | 5/1974 | Alexander | 70/149 |
| 3,877,263 | A | * | 4/1975 | Strickler et al. | 70/149 |
| 3,955,387 | A | | 5/1976 | Best et al. | |
| 3,999,411 | A | * | 12/1976 | Kambic | 70/144 |
| 4,118,056 | A | | 10/1978 | Alexander | |
| 4,453,753 | A | | 6/1984 | Fayerman et al. | |
| 4,572,556 | A | * | 2/1986 | Foshee | 292/165 |
| 4,583,382 | A | | 4/1986 | Hull | |
| 4,674,776 | A | | 6/1987 | James | |
| 4,695,082 | A | | 9/1987 | Marks | |
| 4,844,522 | A | | 7/1989 | Pechar | |
| 5,540,070 | A | | 7/1996 | Adelmeyer | |
| 5,678,870 | A | * | 10/1997 | Pelletier | 292/244 |
| 5,890,385 | A | * | 4/1999 | Lee | 70/472 |
| 5,953,942 | A | * | 9/1999 | Doucet et al. | 70/283 |
| 6,178,789 | B1 | | 1/2001 | Finkelstein et al. | |
| 6,349,982 | B2 | | 2/2002 | Fayngersh et al. | |
| 6,393,878 | B1 | | 5/2002 | Fayngersh et al. | |
| 6,647,753 | B2 | * | 11/2003 | Engler | 70/472 |
| 6,729,169 | B2 | * | 5/2004 | Moore | 70/472 |
| 6,845,642 | B2 | * | 1/2005 | Imedio Ocana | 70/277 |
| 6,993,946 | B1 | * | 2/2006 | Shen | 70/472 |
| 7,007,985 | B2 | | 3/2006 | Alexander et al. | |
| 7,069,755 | B2 | * | 7/2006 | Lies et al. | 70/278.2 |
| 7,108,300 | B2 | | 9/2006 | Hodgin et al. | |
| 7,188,870 | B2 | | 3/2007 | Huang | |
| 7,303,215 | B2 | * | 12/2007 | Moon et al. | 292/32 |
| 7,603,880 | B2 | * | 10/2009 | Chen | 70/107 |
| 2008/0011029 | A1 | * | 1/2008 | Chen | 70/107 |

* cited by examiner

*Primary Examiner* — Thomas Beach
*Assistant Examiner* — Sajid R Ansari
(74) *Attorney, Agent, or Firm* — Eric W. Cernyar

(57) ABSTRACT

A locking system for a stop button employed in a mortise lock having a spindle for operating a latch utilizing a first spindle base and a second spindle base which are nested relative to one another. Each base includes an opening for the mortise lock spindle such that the spindle may enter the combined first and second bases from the left side or the right side. A locking hub overrides either the first or second base and is capable of selectively lying over either the first or second base. An abutment linked to the stop button interacts with the locking hub such that either the first or second base may not be turned by the spindle when this occurs. Locking hub selectively locks either the first or second base through its position relative to the same and allows the mortise lock to easily transform from a left-hand version to a right-hand version.

14 Claims, 3 Drawing Sheets

LOCKING SYSTEM FOR MORTISE LOCK BASE

BACKGROUND OF THE INVENTION

The present invention relates to a novel and useful hub assembly and cooperating stopworks for a reversibly handed mortise lock.

Mortise locks are commonly used in doors and include a number of functions such as permitting the use of a key to unlock or lock the same from the outside, the momentary retraction of a latch, use of deadbolts extended and retracted by a key or turn knob, employment of a guard bolt, and the like. Many mortise locks include stopworks to lock and unlock the operation of the outside handle. Generally, the stopworks takes either a left-handed or a right-handed configuration, requiring pre-manufacturing of mechanisms in a mortise lock to achieve this result.

In the past, many systems have been proposed with respect to mortise locks emphasizing or embellishing particular features. For example, U.S. Pat. No. 4,844,522 describes a latch assembly which utilizes a slide plate that moves relative to adjacent plates. The slide plate moves rearwardly when fingers are engaged by an ear to a cam assembly.

U.S. Pat. Nos. 3,955,387 and 6,178,789 shows cylindrical lock sets which are reversible to suit right-hand and left-handed doors.

U.S. Pat. Nos. 909,888 and 7,188,870 describe mortise type locks in which hubs are employed to allow the lock to be reversible and, in certain cases, to be blocked in usage through the employment of accessible screws.

U.S. Pat. Nos. 4,583,382, 4,695,082, 6,393,878, 6,349,982, 7,007,985, and 7,108,300 describe reversible latch bolts on mortise locks that also include, in certain aspects, dual hubs, each operable by a spindle from opposite sides of the door.

U.S. Pat. No. 5,540,070 illustrates a deadbolt or an auxiliary lock which is reversible through a cast adaptor that includes small and large diameter annular lips on one side and a small diameter lip on the other side.

U.S. Pat. No. 5,678,870 shows a reversible mortise lock utilizing dual spindle hubs and a locking piece which is operated through a pivoting interfering member which then enables only one of the hubs to be used by a spindle.

U.S. Pat. Nos. 3,672,714 and 4,118,056 describe mortise locks having stopworks that are operated either by a toggle or by a retracting lever.

U.S. Pat. Nos. 4,453,753 and 4,674,776 teach mechanisms for mortise lock which employ stopworks buttons which are adapted for either a right-hand or a left-hand door.

A stopworks for a mortise lock button which allows its use in a left-hand or a right-hand door would be a notable advance in the security field.

BRIEF SUMMARY OF THE INVENTION

In accordance with the present invention a novel and useful hub assembly and cooperating stopworks for a mortise lock is herein provided.

The invention utilizes a first base or a spindle base. The spindle base includes an opening for the mortise lock spindle and lies adjacent to a second spindle base which also includes an opening for the mortise lock spindle. Each base sets side-by-side to one another. The handle spindle may be inserted on either side of the mortise lock. Since the opening in the first and second bases are aligned. Each of the first and second bases includes a peripheral outer surface which are adjacent to one another.

A locking hub includes a first surface which is slidingly moveable over either the first or second base by engagement of the peripheral surface of either base. The locking hub also includes a second surface spaced from the outer peripheral surfaces of the first and second spindle bases and may include a slot. A stop button, usually employed with a stopworks mechanism, includes an abutment that extends therefrom and mates with the slot found in the second surface of the locking hub. In this manner, the first and second spindle bases are prevented from rotating with the spindle, whether the spindle is inserted in the first base or the second base on the left-hand side or the right-hand side of the mortise lock. Such an abutment may take the form of a flange which is connected to and extends from the stopworks button. A guide may interpose the first and second bases to maintain the same in a nested configuration such that the identical outer surfaces of the same are held in alignment, permitting the locking hub to easily slide over the top of the first and second bases and be selectively positioned over one or the other. The guide may also include a stop to prevent the spindle, being inserted into either in the first or second base, to travel only so far into the mortise lock. In addition, a fastener may be employed to fix the locking hub into its position either over the first or second spindle hub for use with a left-hand or right-hand door.

It may be apparent that a novel and useful locking system for a mortise lock has been herein hereinabove described.

It is therefore an object of the present invention to provide a mortise lock system which is usable with a stopworks that may be easily adjusted into a configuration for use with a left-hand or a right-hand door.

Another object of the present invention is to provide a locking system for a mortise lock button which is easily convertible from a left-hand to a right-hand door simply by sliding a part between a pair of spindle bases within the mortise lock.

A further object of the present invention is to provide a locking system which includes stopworks buttons and easily adaptable to a left-hand or right-hand doors.

Another object of the present invention is to provide a locking system for a mortise lock which eliminates the need to produce separate mortise lock mechanisms for right-hand and left-hand door systems.

Yet another object of the present invention is to provide a locking system for a mortise lock which is easy to manufacture and maybe readily adjusted for use with left-hand and right-hand doors that are reliable and easily serviced.

The invention possesses other objects and advantages as especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will become apparent from the following detailed description of the preferred embodiments, which are referenced to the prior described drawings.

Figure 1:
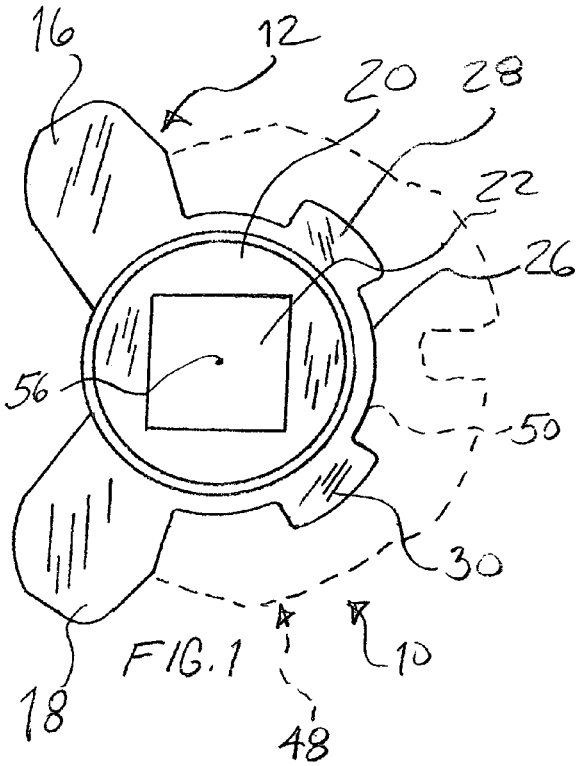
FIG. 1 is a side elevational view of a base or spindle base used in conjunction with a mortise lock showing a phantom locking hub in place about its outer periphery.
Figure 3:
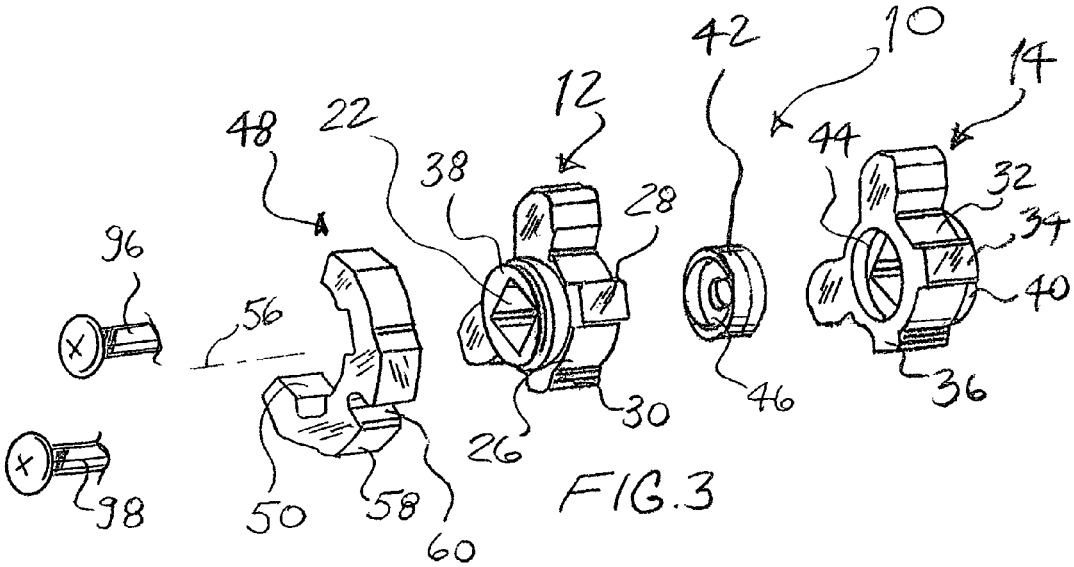
FIG. 3 is an exploded view showing various parts, including a pair spindle bases and locking hub comprising the reversing mechanism found in the present invention.
Figure 4:
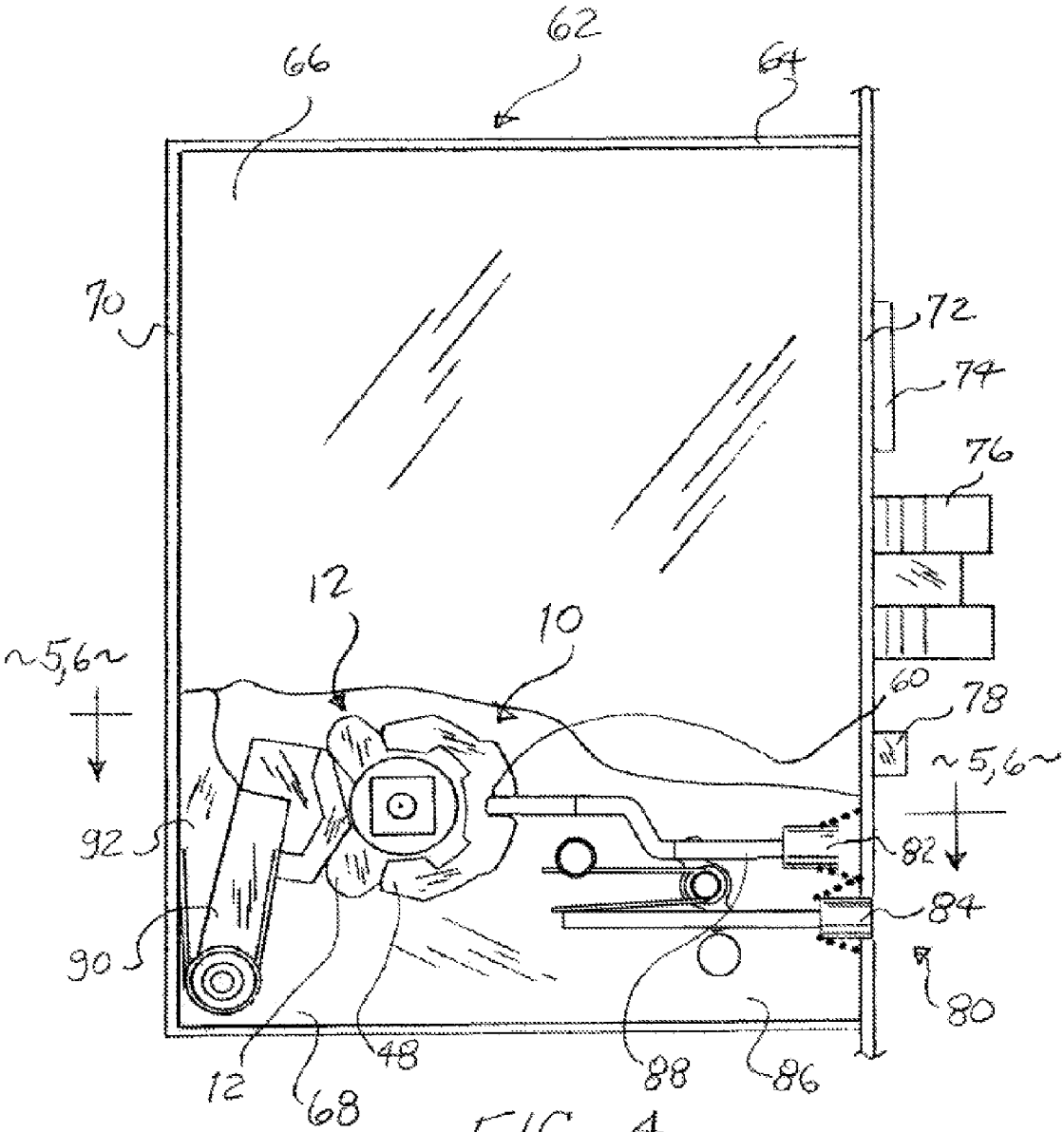
FIG. 4 is a side schematic elevational view of a portion of a mortise lock showing the spindle bases and locking hub in place and being engaged by button of the stopworks having an abutment.

Turning to FIG. 4, an embodiment of a reversibly handed mortise lock 62 is shown that includes, in key part, a dual spindle-operated hub assembly 10. The hub assembly 10, shown in more detail in FIGS. 1 and 3, includes a pair of spindle bases 12 and 14. Base 12, FIG. 1, is, essentially, a mirror image of base 14. Base 12 possesses cam arms 16 and 18, which radiate from a central cylinder 20. Opening 22, of square or rectangular configuration, is designed to engage a spindle 24, FIGS. 5 and 6. Base 12 also includes a peripheral outer surface 26 having raised portions or protuberances 28 and 30. Needless to say, base 14 also includes a peripheral outer surface 32 having identical raised portions or projections 34 and 36. Base 12 is provided with a nose 38 which extends in an opposite direction to nose 40 of base 14. Noses 38 and 40 are configured to fit into openings within a mortise housing or case 64, journaling them for coaxial rotation within the mortise housing 64.

Figure 5:
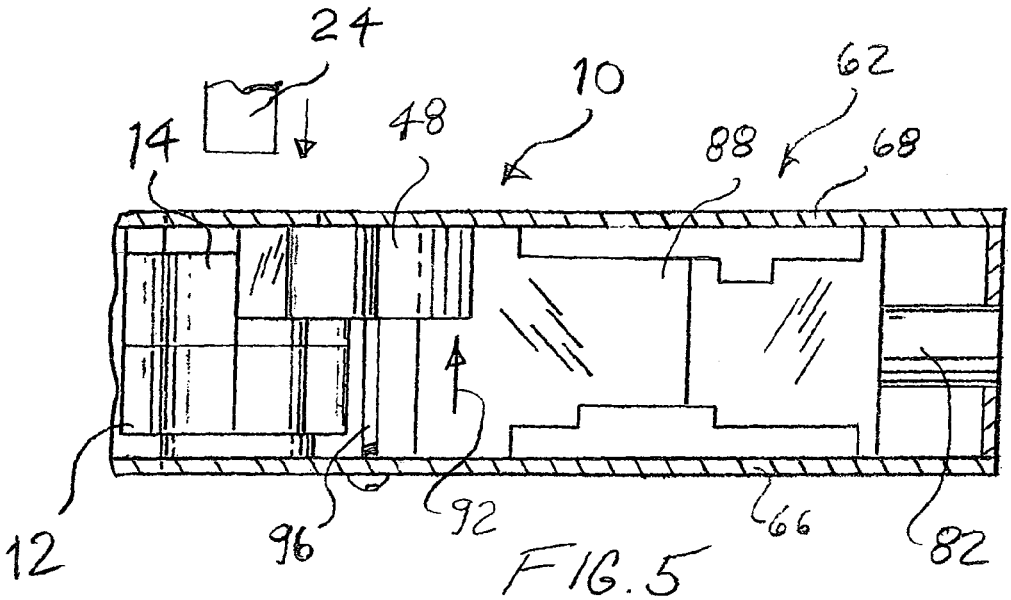
FIG. 5 is a top plan view along line 5-5 of FIG. 4 showing the locking hub in a first position.
Figure 6:
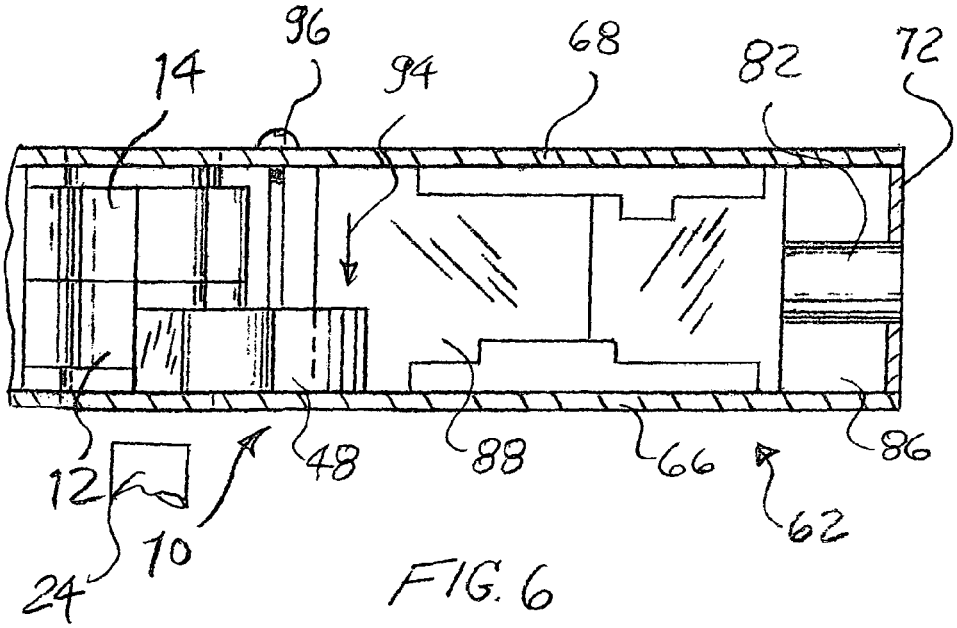
FIG. 6 is a sectional view taken along line 6-6 of FIG. 4, showing the locking hub in a second position.

Opening 22, of square or rectangular configuration, is designed to engage a spindle 24, FIGS. 5 and 6. Base 12 also includes a peripheral outer surface 26 having raised portions or protuberances 28 and 30. Needless to say, base 14 also includes an peripheral outer surface 32 having identical raised portions or projections 34 and 36. Base 12 is provided with a nose 38 which extends in an opposite direction to nose 40 of base 14. Noses 38 and 40 are intended to fit into openings within a mortise housing or case 64 which will be discussed hereinafter.

Guide 42 fits within a circular opening 44 of base 14 and a similar opening in base 12 (not shown), opposite to square opening 22. A square opening exists on base 14 opposite circular opening 44. Guide 42 also includes a plate 46 that serves as a stop to limit the insertion of spindle 24 when locking system 10 of the present invention is installed in a mortise lock 62. Guide 42 fits within the round opening 44 of base 14 and the round opening of base 12 to allow bases 12 and 14 to lie immediately adjacent to one another in a nested configuration. That is to say, bases 12 and 14 are in this position when installed in a mortise lock.

Figure 2:
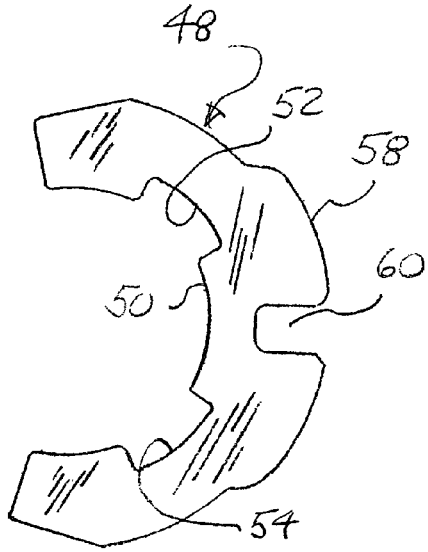
FIG. 2 is a side elevational view of a locking hub used in conjunction with the base of FIG. 1.

Referring now to FIG. 2, it may be seen that a locking collar 48 is also employed in the present invention. Locking collar 48 possesses a first surface 50 which is slidably moveable over first and second bases 12 and 14. Referring again to FIG. 1, it may be apparent that locking collar 48 depicted in phantom as lying over base 12 peripheral outer surfaces 26. In this regard, channels 52 and 54 of collar 48 interlock with projections or protuberance 28 and 30 of base 12. This interlocked coupling prevents the rotational movement of locking collar 48 relative to base 12 about axis 56, FIGS. 1 and 3. Locking collar 48 also includes a second surface 58 which is formed with a slot 60. It should be noted that the rendition of FIG. 1 with respect to base 12 and locking collar 48 may also serve as an illustration of the interaction of locking collar 48 with base 14.

Turning now to FIG. 4, it may be seen that a typical mortise lock 62 is depicted, with the addition of the dual spindle-operated hub assembly 10 of the present invention, schematically and in part, to emphasize the interaction of dual spindle-operated hub assembly 10 with certain portions of mortise lock 62. Mortise lock 62 includes a housing 64 formed of walls 66 and 68, broken away, as well as end plates 70 and 72. Mortise lock 62 includes a deadbolt 74 (partially extended), a latch bolt 76, a guard bolt 78, and stopworks 80 having buttons 82 and 84. Spring loaded arm 90 stabilizes bases 12 and 14 about axis 56 via a known linkage, shown partially by member 92.

The stopworks 80 is operable to transition between locking and unlocking configurations, respectively actuated by buttons 82 and 84. Buttons 82 and 84 work in tandem such that when button 82 is pressed inwardly toward the chamber 86 of mortise lock housing 64, button 84 moved in the opposite direction as shown in FIG. 4. This is achieved through a known mechanism. It should be noted, however, that button 82 includes an abutment or flange 88 that fits into slot 60 of locking collar 48. When this occurs, locking collar 48 prevents the rotation of either spindle base 12 or 14, depending on the position of locking collar 48

With reference to FIGS. 5 and 6, it may be observed that locking collar 48 is laterally moveable in a slidable manner over spindle bases 12 or 14. FIG. 5, shows locking collar 48 over and engaging spindle base 14 by movement from spindle base 12, according to directional arrow 92. As is apparent from FIGS. 3 and 5, in this position the collar 48 does not interfere with rotation of spindle base 12. Likewise, FIG. 6 depicts locking collar 48 engaging spindle base 12 by movement from spindle base 14, according to directional arrow 94. As is apparent from FIGS. 3 and 6, in this position the collar 48 does not interfere with rotation of spindle base 14.

When the stopworks 80 is in a locking configuration, locking collar 48 will not allow the selected interlocked base 12 or 14 to open or close latch 76, although latch 76 may travel through a spring mechanism upon contact with a strike plate (not shown) in a conventional manner. When the stopworks 80 is in an unlocking configuration, locking collar 48, which is coaxial with spindle bases 12 and 14, rotates with the selected base 12 or 14 with which it is interlocked.

A spindle 24 maybe inserted into opening 22 of base 12, FIG. 6. Likewise, a spindle 24 may be inserted into a similar opening found in base 14. It should also be noted that a handle or a knob may be attached to spindle 24 in the conventional manner, (not shown), to operate mortise lock 62.

A removable member, shown in FIGS. 3, 5 and 6 in the form of fasteners 96 and 98, are fastened (from outside the mortise lock housing 64) to a selected wall 66 or 68 of the mortise lock housing 64 to secure locking collar 48 in place either over base 12 or base 14, as selected. Fasteners 96 and 98 may take the form of screws which thread into walls 66 or 68 of mortise housing 64.

In operation, mortise lock 62 is readied for insertion into a door by moving locking collar 48 into the position shown in FIG. 5, or into the position shown in FIG. 6, to accommodate left-handed or right-handed operation. This is achieved by simply sliding locking collar 48 over either spindle base 12 or spindle base 14 as depicted in FIG. 5 or 6 and employing fasteners 96 and 98 to hold locking spindle 48 in this position.

In this manner, the mortise lock 62 is selectively adapted to either a left-handed or a right-handed configuration. Following such arrangement, mortise lock 62 is then placed in a door, allowing a pressed button 82 to engage locking collar 48 by the interaction of abutment or flange 88 with slot 60 of locking hub 48. Such interaction prevents the rotation of either spindle base 12 or 14 as well as any hand lever or knob attached to its corresponding spindle 24.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A reversibly handed mortise lock comprising:

a. a first spindle base journaled for rotation within a mortise housing and engaged for rotation with a mortise lock spindle;

b. a second spindle base, coaxially aligned with the first spindle base, the second spindle base also being journaled for rotation within the mortise housing;

c. a locking collar adapted to slide laterally between first and second positions over the first and second spindle bases, in the first position the locking collar interlocking only the first spindle base, and in the second position interlocking only the second spindle base, and d. a stopworks operable to be actuated between locking and unlocking configurations, the stopworks mechanically interfering with and preventing rotation of the connection of the locking collar and the corresponding spindle base to which it is interlocked at that moment, when the stopworks is in a locking configuration for preventing rotation of the spindle.

2. The reversibly handled mortise lock of claim 1, wherein the stopworks comprises a user-accessible stop button coupled to a flange that, when the stopworks is actuated into a locking configuration, extends into a corresponding slot of the locking collar.

3. The reversibly handed mortise lock of claim 1, further comprising a guide for engaging said first and second spindle bases and maintaining a side by side position of said first and second spindle bases.

4. The reversibly handed mortise lock of claim 1 in which said locking collar is mounted, when the stopworks is in an unlocking configuration, for coaxial rotation with the spindle base to which the locking collar is interlocked.

5. The reversibly handed mortise lock of claim 1, wherein the first spindle base is, structurally, a mirror image of the second spindle base.

6. The reversibly handed mortise lock of claim 1, further comprising a removable member operable to be fastened to a selected one of two opposing walls of the mortise housing in order to secure the locking collar into a selected one of the first and second positions.

7. The reversibly handed mortise lock of claim 6, wherein the removable member comprises a fastener.

8. The reversibly handed mortise lock of claim 7, wherein the fastener comprises a threaded screw.

9. A reversibly handed mortise lock comprising:

a mortise lock housing;

a latch bolt;

first and second spindle bases journaled in the mortise lock housing for rotation about a common axis, each of said first and second spindle bases being coupled to the latch bolt to retract the latch bolt when the spindle base is rotated, wherein the first and spindle bases are, structurally, mirror image opposites of one another;

a locking collar operable to selectively engage with, rotate coaxially with, and selectively prevent rotation of, a selected one of the first and second spindle bases;

a stopworks coupled to the locking collar and operable between locking and unlocking configurations, the locking configuration causing the locking collar to prevent rotation of the selectively engaged spindle base, without interfering with rotation of the opposite spindle base, and the unlocking configuration causing the locking collar to rotate coaxially with the selectively engaged spindle base, allowing both spindle bases to rotate.

10. The reversibly handed mortise lock of claim 9, wherein the locking collar is operable to slide in a lateral direction from a position engaging the first spindle base to a position engaging the second spindle base.

11. The reversibly handed mortise lock of claim 9, further comprising a removable member operable to be fastened to a selected one of two opposing walls of the mortise lock housing in order to secure the locking collar into interlocking engagement with a selected one of the first and second spindle bases without interfering with rotation of the opposite spindle base.

12. The reversibly handed mortise lock of claim 11, wherein the removable member is operable to be fastened to the selected wall of the mortise lock housing from outside the mortise lock housing.

13. The reversibly handed mortise lock of claim 12, wherein the removable member comprises a fastener.

14. The reversibly handed mortise lock of claim 13, wherein the fastener comprises a threaded screw.

* * * * *